US009822502B2

(12) United States Patent
James

(10) Patent No.: US 9,822,502 B2
(45) Date of Patent: Nov. 21, 2017

(54) ENERGY ABSORBING APPARATUS

(75) Inventor: Dallas Rex James, North Harbour (NZ)

(73) Assignee: VALMONT HIGHWAY TECHNOLOGY LIMITED, Auckland (NZ)

( * ) Notice: Subject to any disclaimer, the term of this patent is extended or adjusted under 35 U.S.C. 154(b) by 139 days.

(21) Appl. No.: 14/124,463

(22) PCT Filed: Jun. 7, 2012

(86) PCT No.: PCT/NZ2012/000088
§ 371 (c)(1),
(2), (4) Date: Feb. 26, 2014

(87) PCT Pub. No.: WO2012/169907
PCT Pub. Date: Dec. 13, 2012

(65) Prior Publication Data

US 2015/0292169 A1 Oct. 15, 2015

(30) Foreign Application Priority Data

Jun. 9, 2011 (NZ) ..... 593354

(51) Int. Cl.

| | |
|---|---|
| ***E01F 15/00*** | (2006.01) |
| ***E01F 15/14*** | (2006.01) |
| ***E01F 15/08*** | (2006.01) |
| ***E01F 13/02*** | (2006.01) |

(52) U.S. Cl.
CPC ..... *E01F 15/00* (2013.01); *E01F 13/02* (2013.01); *E01F 15/086* (2013.01); *E01F 15/143* (2013.01); *E01F 15/146* (2013.01)

(58) Field of Classification Search
CPC ..... E04F 15/086; E04F 15/088; E04F 15/143; E04F 15/145; E04F 15/146; E01F 15/00; E01F 13/02; E01F 15/0453; E01F 15/086; E01F 15/088; E01F 15/143; E01F 15/145; E01F 15/146; F16F 7/003; F16F 7/123
USPC ..... 188/377
See application file for complete search history.

(56) References Cited

U.S. PATENT DOCUMENTS

| | | | | |
|---|---|---|---|---|
| 3,412,628 A * | 11/1968 | De Gain | B60R 19/34 | 138/121 |
| 3,528,530 A * | 9/1970 | Franck | B64D 1/14 | 102/400 |
| 4,272,114 A * | 6/1981 | Hirano | F16F 7/12 | 188/377 |
| 4,423,854 A | 1/1984 | Cobb et al. | | |

(Continued)

FOREIGN PATENT DOCUMENTS

| | | |
|---|---|---|
| NZ | 330518 A | 10/1998 |
| NZ | 532473 A | 2/2007 |
| WO | 2005085533 A1 | 9/2005 |

*Primary Examiner* — Michael P Ferguson
*Assistant Examiner* — Matthew R McMahon
(74) *Attorney, Agent, or Firm* — Greer, Burns & Crain, Ltd.

(57) ABSTRACT

An energy absorbing apparatus is provided and includes an outer shell having opposed ends, left and right side walls and a hollow core. The shell further includes a plurality of longitudinally spaced apart fold points positioned on the left and right side walls at a height which substantially corresponds to a center of gravity of a road vehicle where the fold points facilitate a controlled folding of the side walls and at least part of the shell, at or around, the fold points, during an end on impact.

4 Claims, 5 Drawing Sheets

(56) References Cited

U.S. PATENT DOCUMENTS 4,583,716 A * 4/1986 Stephens et al. ..... 256/13.1
4,655,434 A 4/1987 Bronstad
4,674,911 A * 6/1987 Gertz ..... 404/6
4,681,302 A 7/1987 Thompson
4,702,515 A * 10/1987 Kato ..... B62D 21/152 188/377
4,844,213 A * 7/1989 Travis ..... 188/377
5,118,160 A * 6/1992 Kitagawa ..... B62D 21/152 296/187.03
5,123,773 A * 6/1992 Yodock ..... 404/6
5,797,592 A 8/1998 Machado
5,851,005 A * 12/1998 Muller ..... E01F 15/146 256/13.1
5,853,195 A * 12/1998 Le ..... B62D 21/152 188/377
5,967,497 A * 10/1999 Denman et al. ..... 256/13.1
6,024,341 A 2/2000 Gertz
6,116,805 A * 9/2000 Gertz ..... 256/13.1
6,152,521 A * 11/2000 Hayashi ..... B62D 21/152 296/187.09
6,179,516 B1 * 1/2001 Ivey et al. ..... 404/6
6,413,009 B1 * 7/2002 Duckett ..... E01F 15/083 404/6
6,428,237 B1 * 8/2002 Duckett ..... 404/6
6,474,709 B2 * 11/2002 Artner ..... B60R 19/34 293/133
6,474,904 B1 * 11/2002 Duckett ..... E01F 15/086 256/13.1
6,811,144 B2 * 11/2004 Denman et al. ..... 256/13.1
6,854,716 B2 * 2/2005 Bronstad ..... 256/13.1
6,932,201 B2 * 8/2005 Akiyama ..... B60R 19/22 188/371
7,112,004 B2 * 9/2006 Alberson et al. ..... 404/6
7,389,860 B2 * 6/2008 Abu-Odeh et al. ..... 188/377
7,631,924 B2 * 12/2009 Nilsson ..... B60R 19/34 296/133
7,677,615 B2 * 3/2010 Emura ..... B60R 19/18 293/102
7,677,617 B2 * 3/2010 Stewart ..... B60R 19/34 293/133
8,016,513 B2 * 9/2011 Shin ..... E01F 15/146 404/6
8,210,601 B2 * 7/2012 Terada ..... B62D 21/152 293/133
8,376,427 B2 * 2/2013 Perarnau Ramos ..... B21C 37/0815 293/132
2003/0057410 A1 3/2003 Denman et al.
2003/0234390 A1 12/2003 Bronstad
2005/0036832 A1 * 2/2005 Smith et al. ..... 404/6

* cited by examiner

ENERGY ABSORBING APPARATUS

TECHNICAL FIELD

The present specification details an energy absorbing apparatus. In particular the present invention relates to an energy absorbing apparatus with particular application to a temporary barrier.

BACKGROUND

The present invention has particular application to lightweight temporary barriers which can be transported from one location to another and deployed as required. However, as will be understood the energy absorbing apparatus of the present invention may also be used in other applications where it can be employed as a crash cushion.

For ease of reference only the present invention will now be discussed in relation to temporary plastic barriers.

The use of hollow elongate plastic barrier sections to create temporary barriers is well known in the art. The plastic barrier sections are relatively lightweight which makes them easy to move and transport from location to location. Once a barrier has been set up by connecting the desired number of the barrier sections each section is then filled with water in order to provide the necessary mass required so the barrier can function to redirect errant vehicles back onto the road or other desired path. However, a problem with such barriers is that they are designed for side redirects and thus a head on collision between a vehicle and the terminal end of the barrier can be fatal.

It would therefore be useful if there could be provided a special purpose barrier section which can be used at the terminal end of a temporary plastic barrier to absorb the energy of a head on impact in a controlled manner.

Some plastic barriers have used two types of plastic a strong plastic for the bulk of the barrier section and a weaker plastic for a region which is designed to fail before the stronger section. However, such barrier sections are expensive to manufacture and what part of the weaker region fails first is completely up to chance so the amount of energy effectively absorbed can vary between barrier sections depending on which part of the weaker region failed first.

It would also be useful if there could be provided a special purpose barrier section which addresses the aforementioned problems and is made from a single material.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It is an object of the present invention to address the foregoing problems or at least to provide the public with a useful choice.

Further aspects and advantages of the present invention will become apparent from the ensuing description which is given by way of example only.

SUMMARY

The specification details an energy absorbing apparatus which is in the form of a hollow elongate barrier section which can be used as the terminal end of a barrier. The barrier section has a plurality of fold points positioned there along which facilitate folding up of the barrier to absorb energy during a head on (end on) impact with the barrier.

According to a first aspect of the present invention there is provided an energy absorbing apparatus comprising:

an outer shell with a left and right side wall and having a hollow core; and wherein the shell has been adapted to have a plurality of longitudinally spaced apart fold points positioned on the left and right side wall at a height which substantially corresponds to the centre of gravity of a road vehicle; and wherein the fold points facilitate a controlled folding up of the sides and at least part of the shell, at or around, the fold points, during a head on impact.

Preferably, although not exclusively, the energy absorbing apparatus may have left and right side walls which are corrugated when viewed in transverse cross section. The ridges being the strongest points of the barrier. In some preferred embodiments at least one ridge in the corrugated walls includes the fold points.

Preferably, the controlled folding up of the barrier, at or near, the fold points is in the nature of a concertinaing action wherein at least a portion of the barrier collapses in folds resembling those of a concertina.

In some preferred embodiments the energy absorbing apparatus is in the form of an elongate barrier section.

The barrier section may be a custom made, or may be a modified barrier section.

Preferably, the barrier section may be made of plastic. Most preferably, the plastic may be high density polyethylene or a plastic or other material having similar strength and weight characteristics.

However, this should not be seen as limiting as the energy absorbing apparatus could be made of aluminium or thin steel or other lightweight yet strong material.

According to a second aspect of the present invention there is provided a temporary plastic barrier wherein the barrier includes a number of elongate barrier sections connected to one another and wherein at least one terminal end of the barrier includes an energy absorbing apparatus substantially as described above.

BRIEF DESCRIPTION OF DRAWINGS

Further aspects of the present invention will become apparent from the following description which is given by way of example only and with reference to the accompanying drawings in which:

FIG. 2*b*) head on impact with the end of a barrier has occurred;

DETAILED DESCRIPTION

Figure 1:
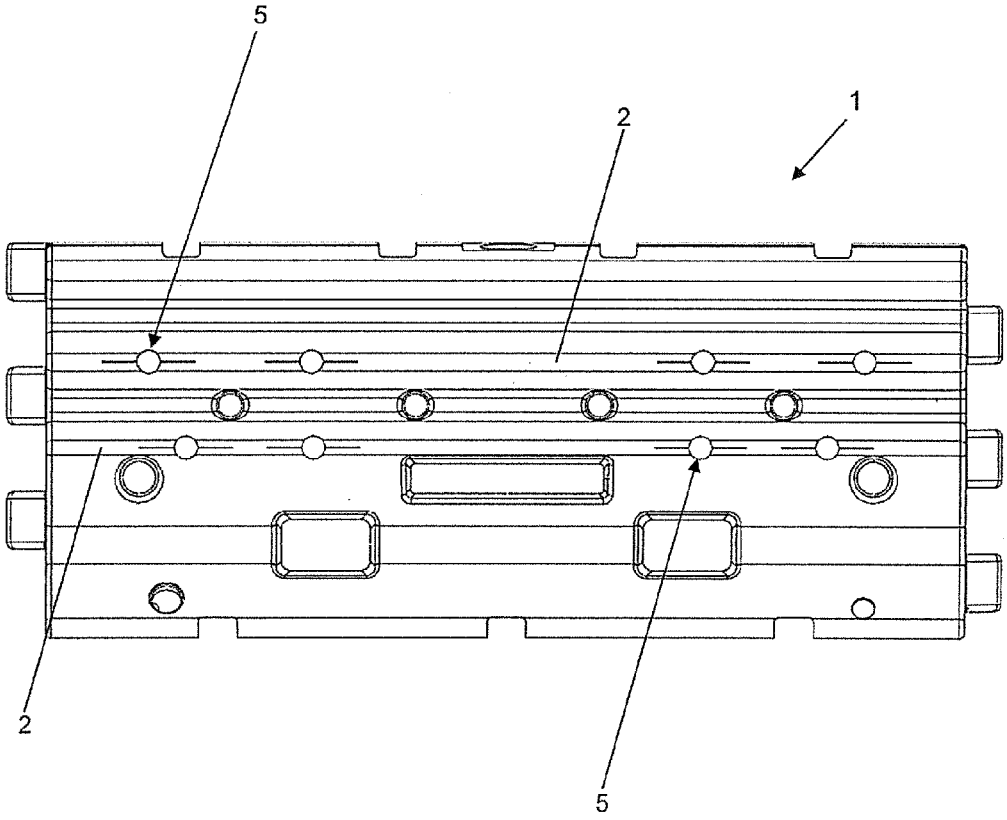
FIG. 1 is a side view of a temporary plastic barrier section prior to a head on impact according to one preferred embodiment of the present invention.
Figure 3:
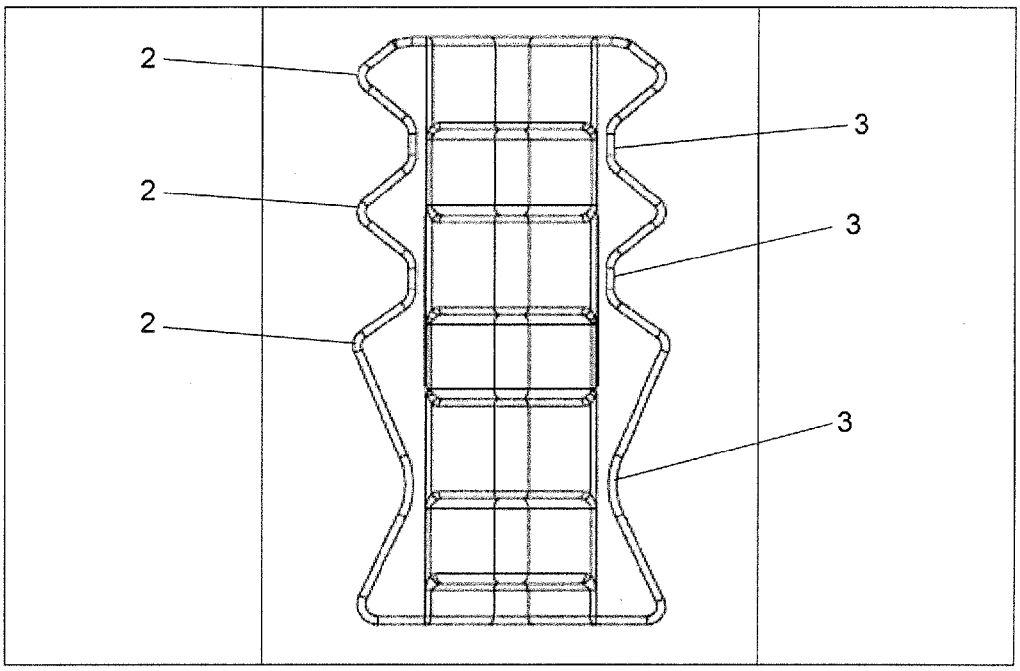
FIG. 3 shows an end of view of the barrier section shown in FIG. 1.

In FIG. 1 there is provided a barrier section 1 made from high density polyethylene which can be used as the terminal end of a barrier to absorb the energy of end on impacts with the barrier. The barrier section 1 has a hollow interior and has corrugations having ridges 2 and troughs 3 (refer FIG. 3) which extend longitudinally along the side walls (of which only one is shown). The middle two ridges have been adapted to include fold points in the form of slotted holes 5 at a number of positions. In use this barrier section 1 unlike the barrier sections making up the barrier is not filled with water.

Figure 2A:
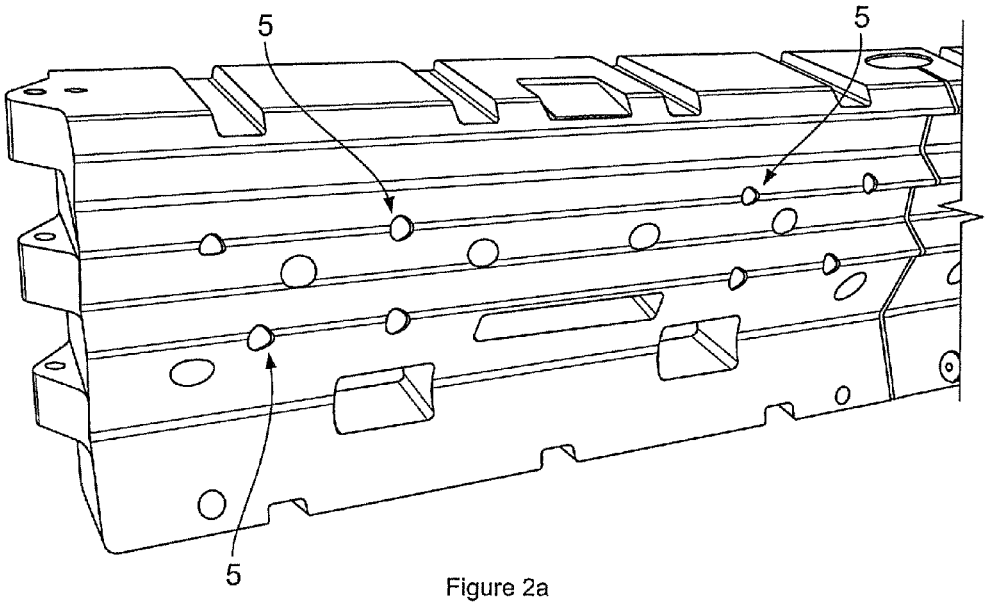
FIG. 2*a* is a photograph of a side view of a temporary plastic barrier section as shown in FIG. 1 before a head on impact with the end of a barrier has occurred.
Figure 2B:
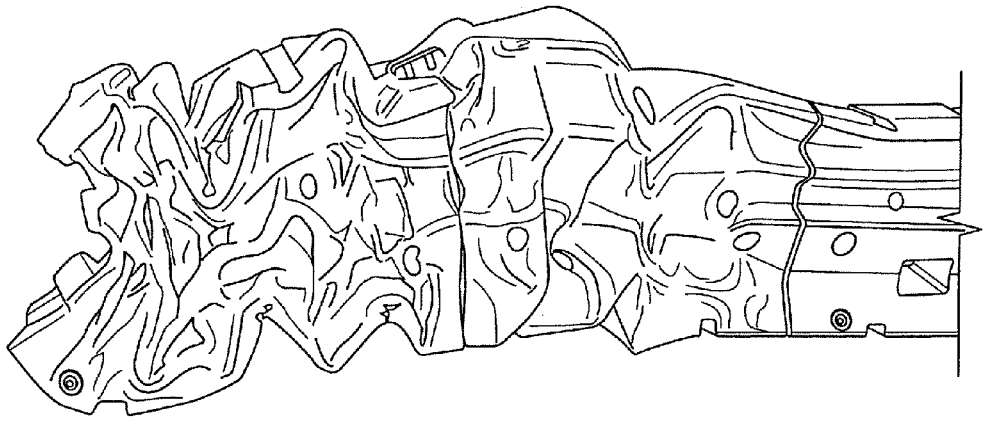
FIG. 2*b* is a photograph of a side view of a temporary plastic barrier section as shown in FIG. 1 after a high speed head on impact with the end of a barrier has occurred.
Figure 2C:
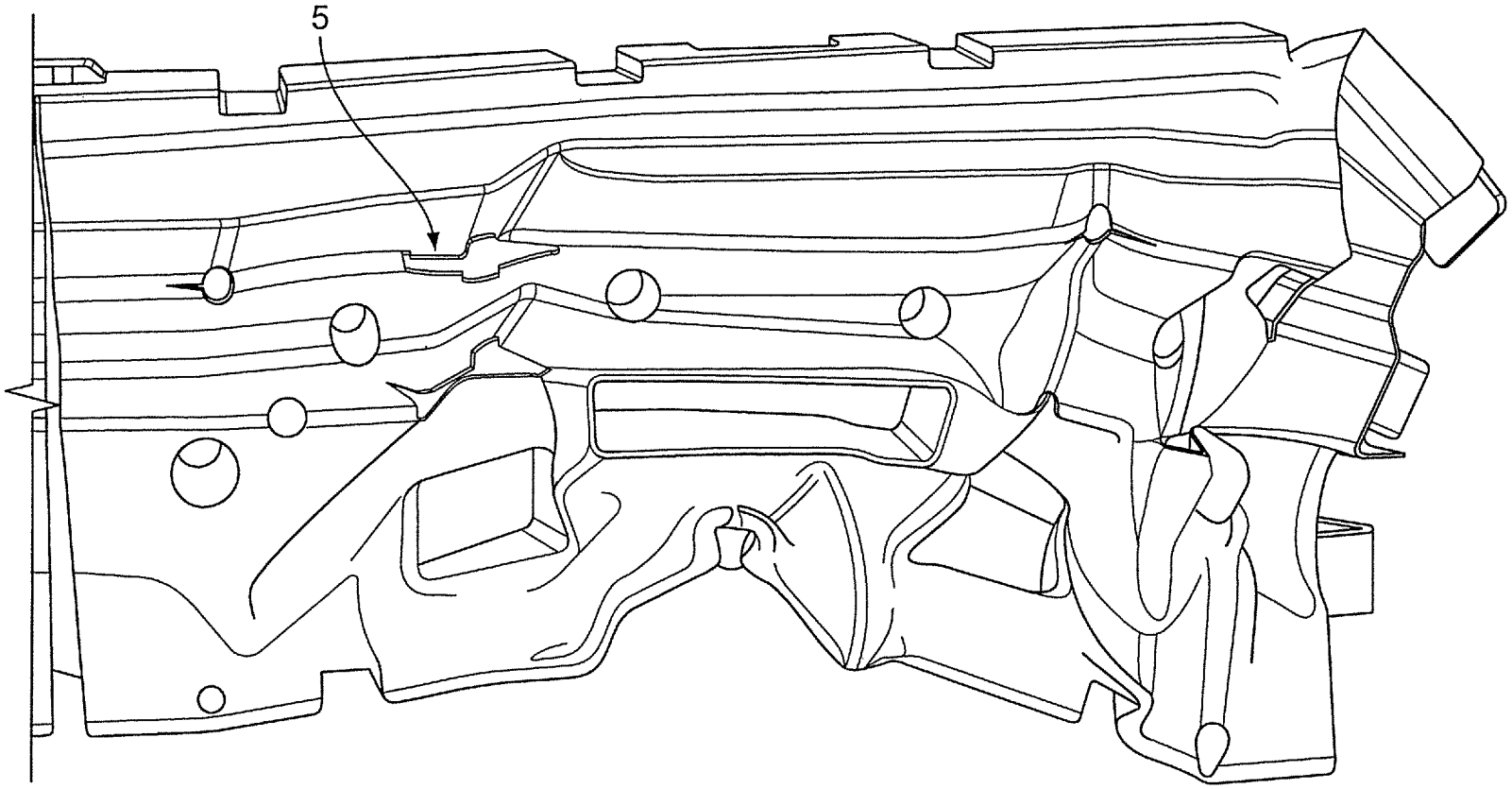
FIG. 2*c* is a photograph of a side view of a temporary plastic barrier section as shown in FIG. 1 after a lower speed (cf.

During a head on collision the fold points which are regions of weakness along the ridges 2 facilitates the ridges folding/buckling and cause the ridges/barrier to fold and concertina —refer FIGS. 2*a*, 2*b* and 2*c* which show the barrier section pre- and post-impact. As the middle of the barrier is the first part of the barrier section to connect with the vehicle at or near bumper height (centre of gravity) this part of the barrier compresses faster and easier than the rest of the barrier section to quickly absorb energy. Further, as can be seen as the middle ridges concertina to a greater extent than the non weakened top and bottom ridges this creates a C-shaped (or reverse C-Shaped) depression at the upstream end of the barrier section which captures the front of the errant vehicle—refer FIG. 2*b*. FIG. 2*c* shows how the slotted holes 5 open up as a result of a head on impact with the end of the barrier.

Figure 4:
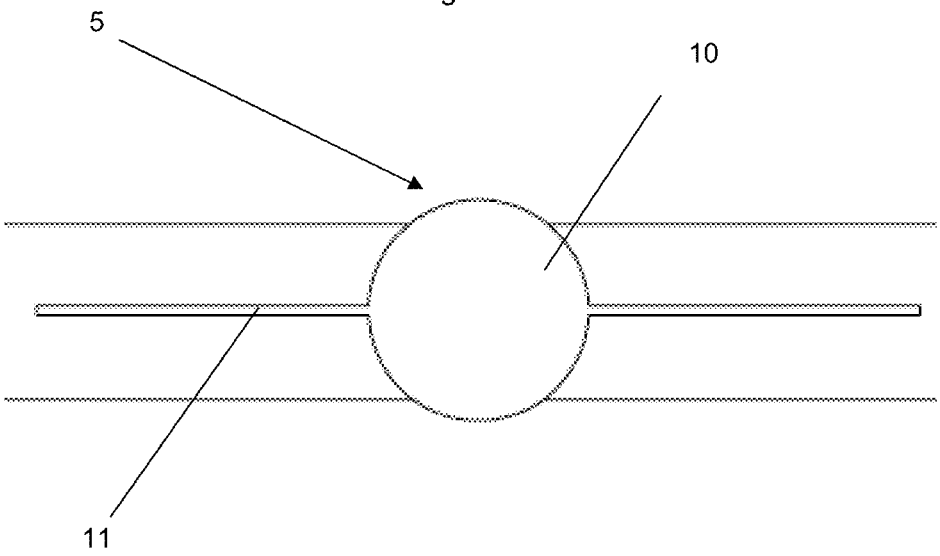
FIG. 4 shows the slotted holes of FIG. 1 in more detail.

FIG. 4 shows the slotted holes 5 in greater detail illustrating the central aperture 10 and horizontal slot 11 extending out from the edges of the central aperture 10.

Alternate Embodiments

For ease of reference only the present invention will now be described in relation to an elongate plastic barrier section. However, it should be appreciated this should not be seen as limiting.

The plastic may be any plastic having suitable characteristics for an energy absorbing barrier.

In preferred embodiments the plastic may be high density polyethylene.

The exact configuration of the corrugations may vary without departing from the scope of the present invention.

The fold points can be configured in a number of ways.

In some preferred embodiments the fold points are in the form of holes or slots or a combination thereof.

In some other preferred embodiments the fold points may be in the form of two intersecting slots which form a cross.

The number and positioning of the fold points along the barrier section may vary.

The term concertinaing as used herein refers to the collapse of the barrier section by controlled folding of the barrier section.

Aspects of the present invention have been described by way of example only and it should be appreciated that modifications and additions may be made thereto without departing from the scope of the appended claims.

What we claim is:

1. A road barrier energy absorbing apparatus comprising:

a substantially enclosed free standing outer shell having opposed end walls, left and right side walls, and top and bottom walls connected together, wherein the bottom wall forms a flat base supporting the outer shell, and a hollow core situated therebetween, said shell including a plurality of longitudinally spaced apart fold points in the form of apertures bounded by horizontally extending slots on either side thereof positioned on the left and right side walls of the outer shell and extending therethrough at a height at which a center of gravity of a road vehicle would be capable of impacting;

said fold points being configured for facilitating a controlled folding of the sides and at least part of the shell, at or around, the fold points, during an end on impact; and wherein there are no fold points located on the top wall and the end walls of the barrier;

wherein the left and right side walls are corrugated when viewed in a transverse cross-section such that they include horizontally extending alternating troughs and ridges;

wherein the fold points are located on at least one ridge of the corrugated walls, such that the aperture of each fold point is located on a respective ridge and the horizontal slots extend longitudinally from either side of the aperture along the respective ridge.

2. The road barrier energy absorbing apparatus of claim 1, wherein the apparatus is in the form of an elongate barrier section.

3. A temporary road barrier including a number of elongate barrier sections connected to one another, wherein at least one terminal end of the barrier includes an energy absorbing apparatus as claimed in claim 1.

4. A temporary road barrier including a number of elongate barrier sections connected to one another, wherein at least one terminal end of the barrier includes an energy absorbing apparatus as claimed in claim 2.

* * * * *